US007026996B2

(12) United States Patent
Harano

(10) Patent No.: US 7,026,996 B2
(45) Date of Patent: Apr. 11, 2006

(54) ANTENNA APPARATUS HAVING HIGH RECEIVING EFFICIENCY

(75) Inventor: Nobuya Harano, Shizuoka (JP)

(73) Assignee: NEC Corporation, Tokyo (JP)

( * ) Notice: Subject to any disclaimer, the term of this patent is extended or adjusted under 35 U.S.C. 154(b) by 27 days.

(21) Appl. No.: 10/784,159

(22) Filed: Feb. 24, 2004

(65) Prior Publication Data

US 2004/0227675 A1 Nov. 18, 2004

(30) Foreign Application Priority Data

Feb. 25, 2003 (JP) ..... 2003-047598

(51) Int. Cl.
*H01Q 1/38* (2006.01)

(52) U.S. Cl. ..... 343/700 MS; 343/702; 343/833

(58) Field of Classification Search ..... 343/700 MS, 343/702, 846, 833, 815
See application file for complete search history.

(56) References Cited

U.S. PATENT DOCUMENTS

| | | | | |
|---|---|---|---|---|
| 5,861,854 | A * | 1/1999 | Kawahata et al. | 343/702 |
| 5,966,097 | A | 10/1999 | Fukasawa et al. | |
| 6,147,650 | A * | 11/2000 | Kawahata et al. | 343/700 MS |
| 6,295,030 | B1 * | 9/2001 | Kozakai et al. | 343/700 MS |
| 6,456,249 | B1 * | 9/2002 | Johnson et al. | 343/702 |
| 6,552,686 | B1 * | 4/2003 | Ollikainen et al. | 343/700 MS |
| 6,650,294 | B1 * | 11/2003 | Ying et al. | 343/700 MS |
| 2002/0021248 | A1 | 2/2002 | Ying et al. | |

FOREIGN PATENT DOCUMENTS

| | | | |
|---|---|---|---|
| JP | 62-161410 | U | 10/1987 |
| JP | 6-069715 | A | 3/1994 |
| JP | 6-334420 | A | 12/1994 |
| JP | 9-326632 | | 12/1997 |
| JP | 11-312923 | A | 11/1999 |
| JP | 11-330842 | A | 11/1999 |
| JP | 2000-31721 | A | 1/2000 |
| WO | WO 02/13307 | A1 | 2/2002 |

OTHER PUBLICATIONS

K. Hirose et al., "A Two-Wire Spiral Antenna With Unbalanced Feed", Tokyo Denki University, College of Science and Engineering, pp. 128-131, IEEE 2001, XP 10564599A1.

* cited by examiner

*Primary Examiner*—Tan Ho
(74) *Attorney, Agent, or Firm*—Foley & Lardner LLP

(57) ABSTRACT

An antenna apparatus comprise a main antenna line element (22) and a parasitic antenna line element (23) which are located above a conductive plate (21). A feeding terminal (24) is connected to a first end portion (221) of the main antenna line element (23). A second end portion (222) of the main antenna line element (23) comprises an open end. A grounding terminal (25) is connected to a third end portion of the parasitic antenna line element (23). A fourth end portion (232) comprises an open end. The first end portion (221) is close to the third end potion (233) and extend opposite directions. The second end portion (222) extend in the direction perpendicular to the first and the third end portions (221 and 231).

7 Claims, 5 Drawing Sheets

ANTENNA APPARATUS HAVING HIGH RECEIVING EFFICIENCY

This application claims priority to prior application JP 2003-47598, the disclosure of which is incorporated herein by reference.

BACKGROUND OF THE INVENTION

This invention relates to an antenna apparatus used for a radio communication device such as a mobile telephone, in particular, to an antenna apparatus having high receiving efficiency under variable radio propagation circumstances.

Recently, with miniaturization of a mobile telephone, a space for a built-in antenna apparatus is reduced. Consequently, it becomes harder to obtain desirable antenna characteristics for the mobile telephone.

Wide directivity is (or omnidirectional characteristics are) required for the built-in antenna apparatus of the mobile telephone because movement of the mobile telephone frequently varies radio propagation circumstances. However, it is often that the built-in antenna apparatus has narrow directivity. This partially comes from influence of a casing of the mobile telephone. The narrow directivity makes receiving radio signals having different polarization planes difficult.

SUMMARY OF THE INVENTION

It is therefore an object of this invention to provide an antenna apparatus having high receiving efficiency under variable radio propagation circumstances.

Other object of this invention will become clear as the description proceeds.

According to an aspect of this invention, an antenna apparatus used for a radio communication device comprises a conductive plate. A main line antenna element is located parallel to the conductive plate and has first and second end portions extending in different directions perpendicular to each other. The first end portion provides a feeding point. The second end portion forms an open end. A parasitic line antenna element is located parallel to the conductive plate and has third and forth end portions to be electrostatically coupled with the main antenna element. The main line antenna element and the parasitic line antenna element are located so that the first end portion is closer to the parasitic line antenna than the second end portion and parallel to the third and the forth end portions.

DESCRIPTION OF THE PREFERRED EMBODIMENTS

Figure 1:
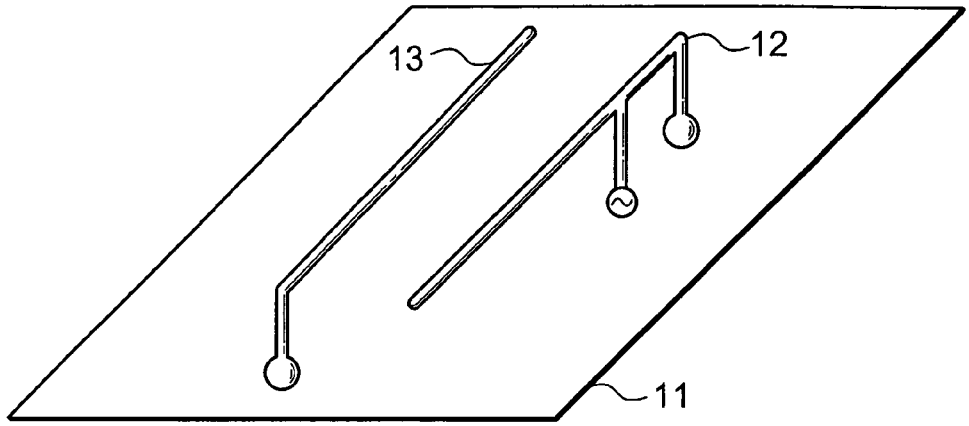
FIG. 1 PRIOR ART
FIG. 1 is a schematic perspective view of a related antenna apparatus.

Referring to FIG. 1, description will be at first directed to a related antenna apparatus for a better understanding of this invention.

As illustrated in FIG. 1, the related antenna apparatus comprises a conductive flat plate 11 and line conductors 12 and 13 located above the conductive flat plate 11. The line conductors 12 and 13 are practically in parallel to the conductive plate 11 and to each other. Each of the line conductors 12 and 13 has a pair of ends one of which is short-circuited to the conductive plate 11 and the other of which comprises (or forms) an open end. The line conductors 12 and 13 are oriented in opposite directions. In detail, the line conductor 12 is grounded at an upper side of FIG. 1 while the line conductor 13 is grounded at a lower side of FIG. 1. The line conductor 12 further has a feeding point between the ends thereof.

With the structure, the related antenna apparatus can have desired impedance characteristics. Furthermore, the related antenna apparatus needs a small space because height in a direction perpendicular to the conductive plate 11 can be reduced.

However, the related antenna apparatus has problem that receiving efficiency widely varies according to posture of the mobile telephone and radio propagation circumstances. For instance, there is a case where the receiving efficiency deteriorates when the mobile telephone is changed from a standing state to a laying state. Furthermore, there is another case where the antenna apparatus can receive a signal derived from a desirable signal and having a particular plane of polarization while it can not receive another signal derived from the desirable signal and having another particular plane of polarization. This means that some moving distance of the mobile telephone disables the antenna apparatus from receiving the desirable signal in a city area.

Figure 2:
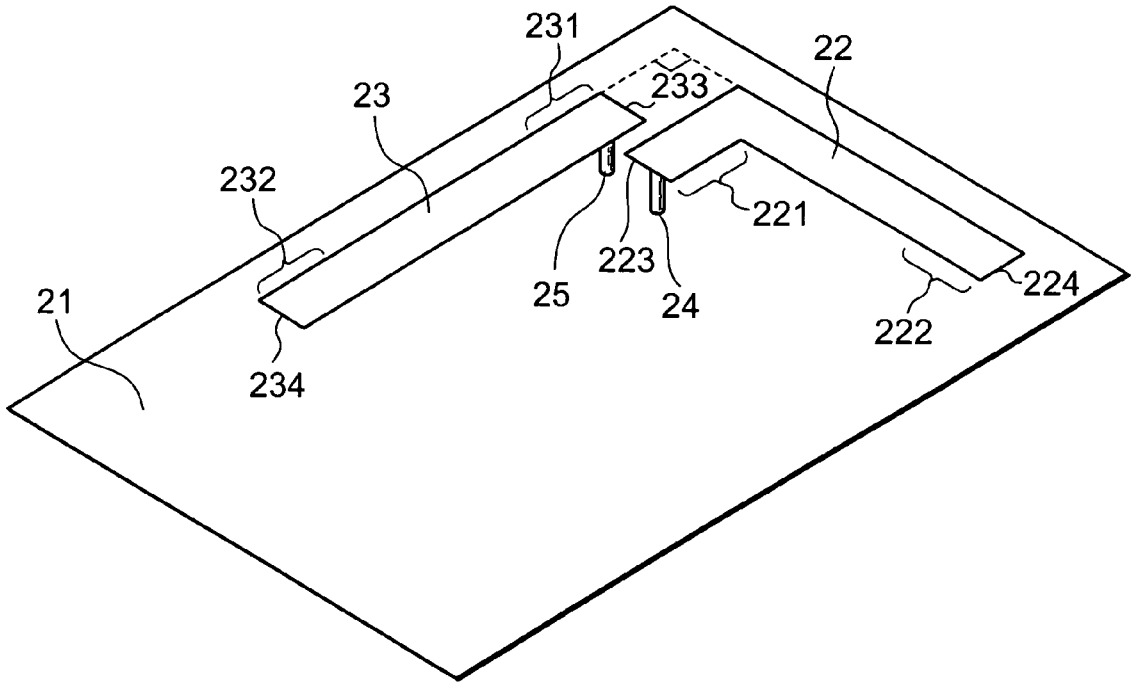
FIG. 2 is a schematic perspective view of an antenna apparatus according to a first embodiment of this invention.
Figure 3:
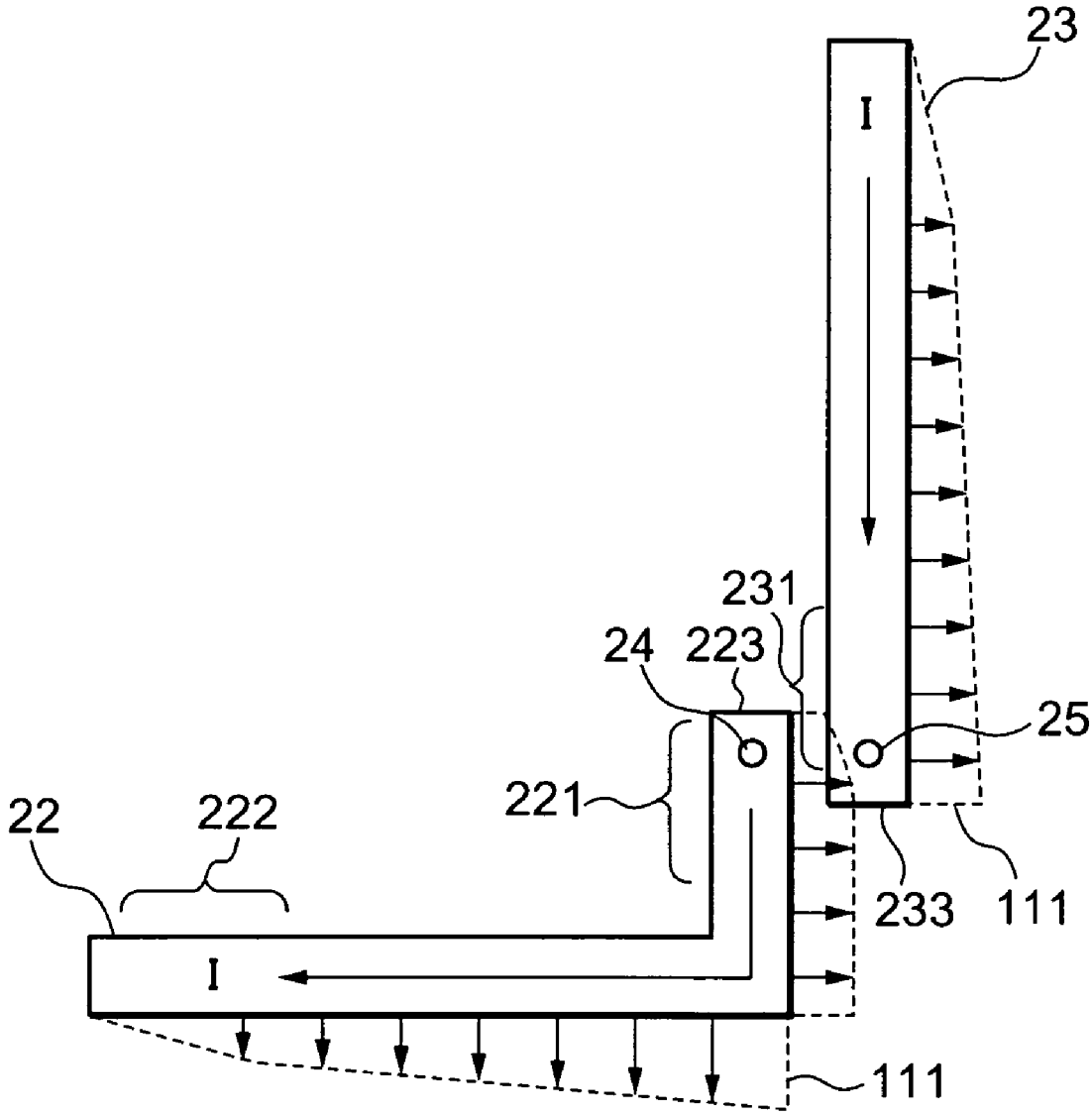
FIG. 3 is a diagram for describing amplitude of currents flowing on a main antenna line element and on a parasitic antenna line element of the antenna apparatus of FIG. 2.

Referring to FIGS. 2 to 4, the description will be proceed to an antenna apparatus according to a first embodiment of this invention.

FIG. 2 is a schematic perspective view of the antenna apparatus. As illustrated in FIG. 2, the antenna apparatus comprises a conductive plate 21, a main antenna line element 22 and a parasitic antenna line element 23. The antenna line elements 22 and 23 are located above the conductive plate 21 to be substantially parallel to the conductive plate 21.

The main antenna line element 22 comprises an L shaped thin metal plate with first and second end portions 221 and 222. The first and second end portions 221 and 222 include longitudinal edges 223 and 224 and extend in different directions which are substantially perpendicular to each other. The first end portion 221 provides a feeding point which is connected to a radio transmitter/receiver circuit (42 of FIG. 4A) mounted on the conductive plate 21 with a feeding terminal 24. The feeding point is close to the longitudinal edge 223. The second end portion 222 comprises (or forms) an open end connected to nothing. With this structure, the main antenna line element 22 serves as a driven element.

The parasitic antenna line element 23 comprises an I shaped thin metal plate with third and forth end portions 231 and 232 which are on a strait line. The third and the forth end portions 231 and 232 includes longitudinal edges 233 and 234. The parasitic antenna line element 23 is substantially parallel to the first end portion 221 of the main antenna line element 22. The third end portion 231 provides a grounding point grounded to the conductive plate 21 with a grounding terminal 25. The grounding point is close to the longitudinal edge 233. The fourth end portion 232 comprises an open end connected to nothing. The third end portion 231 is closer to the first end portion 221 of the main antenna line element 22 than the fourth end portion 232.

Next, an operation of the antenna apparatus of FIG. 2 will be described with reference to FIG. 3.

FIG. 3 is for describing amplitude of currents flowing on the main antenna line element 23 and on the parasitic antenna line element 23.

When the main antenna line element 22 is fed from the feeding point, a current flows from one end to the other end thereof. FIG. 3 shows a case where the current flows from the first end portion 221 to the second end portion 222. In this time, electrostatic induction causes another current on the parasitic antenna line element 23. For the electrostatic induction, the parasitic antenna line element 23 has characteristic impedance substantially equal to impedance of the main antenna line element 22 fed with an input signal having a predetermined frequency. In other words, the parasitic antenna line element 23 has a resonance frequency equal or close to that of the main antenna line element 22.

When an input signal supplied to the feeding point has a wave length of $\lambda$ and the main antenna line element 22 has a length shorter than $\lambda/4$, the current flowing on the main antenna line element 22 has the maximum value in vicinity of the feeding point. The maximum value also appears in the vicinity of the feeding point on condition that the length of the main antenna line element 22 is longer than and closer to $\lambda/4$. Incidentally, the maximum value point is closer to the open end (or the second end portion 222) with increase of the length of the main antenna line element 22.

Accordingly, to strengthen the electrostatic induction between the main antenna line element 22 and the parasitic antenna line element 23, the grounding terminal 25 is placed in close to the feeding terminal 24. The first end portion 221 and the third end portion 231 are partially neighboring each other at vicinity of the feeding point. The longitudinal edges 223 and 233 (or the first and the third end portions 221 and 231) are oriented in opposite direction. With this structure, the electrostatic induction are strengthened between the main antenna line element 22 and the parasitic antenna element 23.

The second end part is included in a major part of the main antenna line element 22. The major part of the main antenna line element 22 extends in the direction perpendicular to the parasitic antenna line element 23. Accordingly, the antenna apparatus can efficiently receive both a vertical horizontal signal and a horizontal polarization signal which are transmitted from a base station in various using conditions.

Figure 4A:
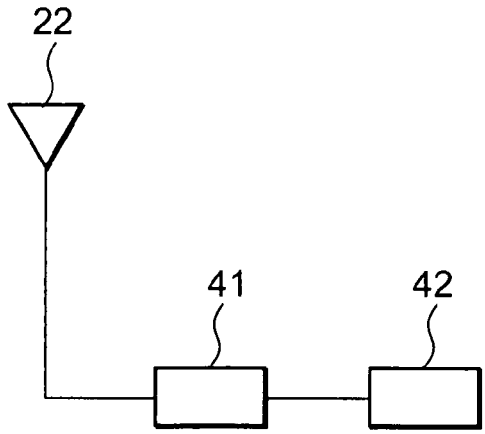
FIG. 4A is a block diagram for describing connection between the main antenna line element and a conductive plate of the antenna apparatus of FIG. 2.
Figure 4B:
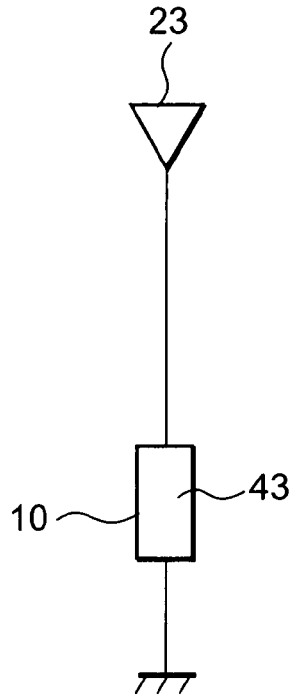
FIG. 4B is a block diagram for describing connection between the parasitic antenna line element and a radio transmitter/receiver circuit mounted on the conductive plate of the antenna apparatus of FIG. 2.

Additionally, as illustrated in FIG. 4A, the main antenna line element 22 may be connected to the radio transmitter/receiver 42 through a matching circuit 41. Similarly, the parasitic antenna line element 23, as shown in FIG. 4B, may be grounded through an impedance matching element 43. The matching circuit 41 is used to adjust impedance of the main antenna line element 22 while the impedance matching element 43 is used to adjust impedance of the parasitic antenna line element 23. Because the matching circuit 41 is independent of the impedance matching element 43, impedance adjustment about the parasitic antenna line element 23 can be made regardless of the main antenna line element 22. Thus, it is easy to match impedance between the main antenna line element 22 and the parasitic antenna line element 23.

Figure 5:
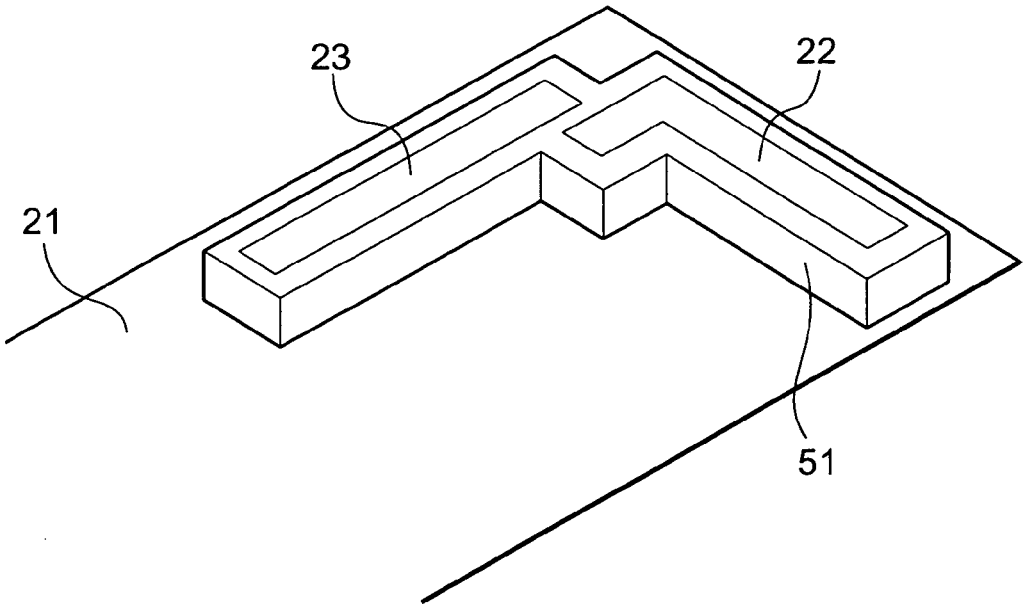
FIG. 5 is a schematic perspective view of an antenna apparatus according to a second embodiment of this invention.

FIG. 5 is a schematic perspective view of an antenna apparatus according to a second embodiment of this invention. Similar parts are designated by the same reference numerals.

The antenna apparatus is similar to that of first embodiment except a resin member 51. That is, the antenna apparatus of FIG. 5 comprises the conductive plate 21, the main antenna line element 22, the parasitic antenna line element 23 and the resin member 51.

The resin member 51 unifies the main antenna line element 22 and the parasitic antenna line element 23 to maintain relative arrangement between the main antenna line element 22 and the parasitic antenna line element 23. That is, the resin member 51 maintains a distance between the main antenna line element 22 and the parasitic antenna line element 23 and impedance of them. Furthermore, the resin member 51 prevents both the main antenna line element 22 and the parasitic antenna line element 23 from being deformed. This makes assembling the antenna apparatus easy.

Figure 6:
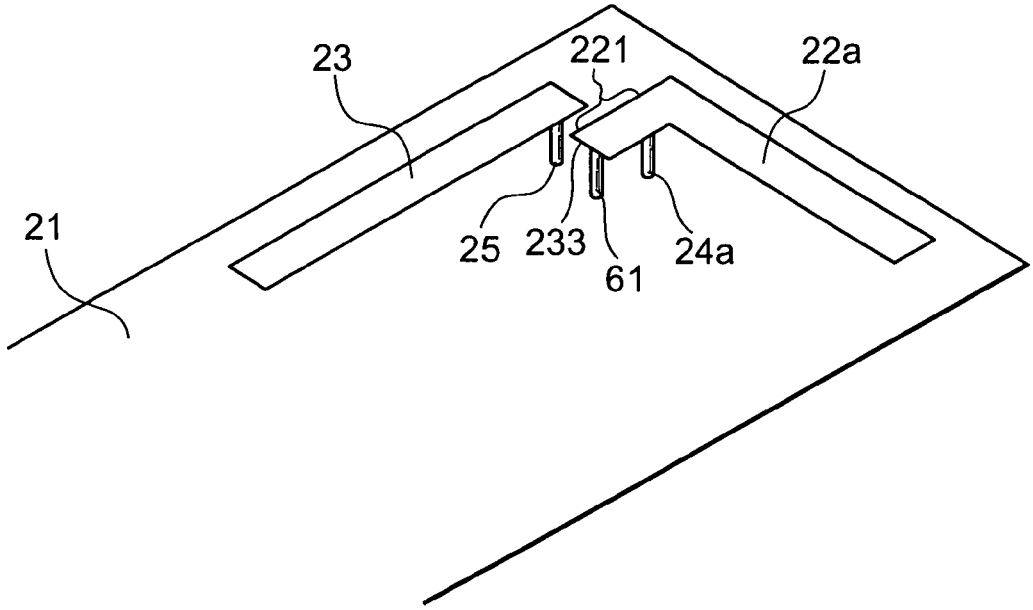
FIG. 6 is a schematic perspective view of an antenna apparatus according to a third embodiment of this invention.

FIG. 6 is a schematic perspective view of an antenna apparatus according to a third embodiment of this invention.

The antenna apparatus comprises a main antenna line element 22*a*. The main antenna line element 22*a* has a total length shorter than that of the main antenna line element 22 of FIG. 2 or 5. The main antenna line element 22*a* is grounded to the conductive plate 21 with a grounding terminal 61. The grounding terminal 61 is connected to the first end portion 233 together with a feeding terminal 24*a*. The grounding terminal 61 is closer to the longitudinal edge 233 than the feeding terminal 24*a*. With this structure, the shorter length of the main antenna line element 22*a* makes it possible to miniaturize the whole of the antenna apparatus.

Figure 7:
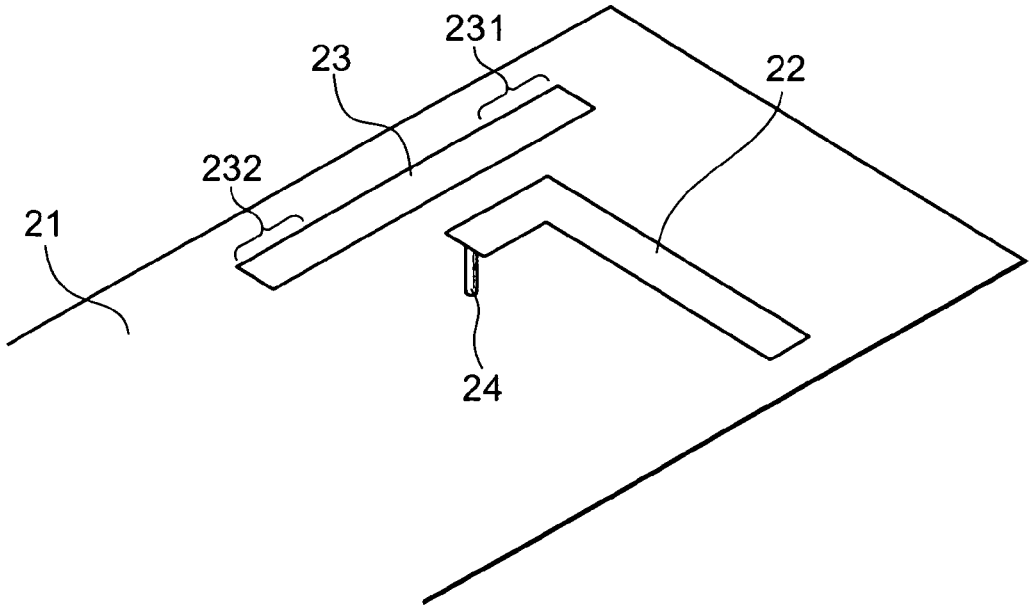
FIG. 7 is a schematic perspective view of an antenna apparatus according to a fourth embodiment of this invention.

FIG. 7 is a schematic perspective view of an antenna apparatus according to a forth embodiment of this invention.

The antenna apparatus has no grounding terminal connected to the parasitic antenna line element. In other words, both of the third and the fourth end portions 231 and 232 form open ends. Based on this, the main antenna line element 22 is closer to the fourth end portion 232 than the case of FIG. 2. In detail, the feeding point connected to the feeding terminal 24 is placed at vicinity of the center of the parasitic antenna line element 23. In other words, the feeding point is located at equal distances from the open ends. This is because it is often that the maximum value of the current flowing on the parasitic antenna line element 23 appears at the center of the parasitic antenna line element 23. By placing the feeding point near the center of the parasitic antenna line element 23, electrostatic induction is strengthened between the main antenna line element 22 and the parasitic antenna line element 23.

Figure 8:
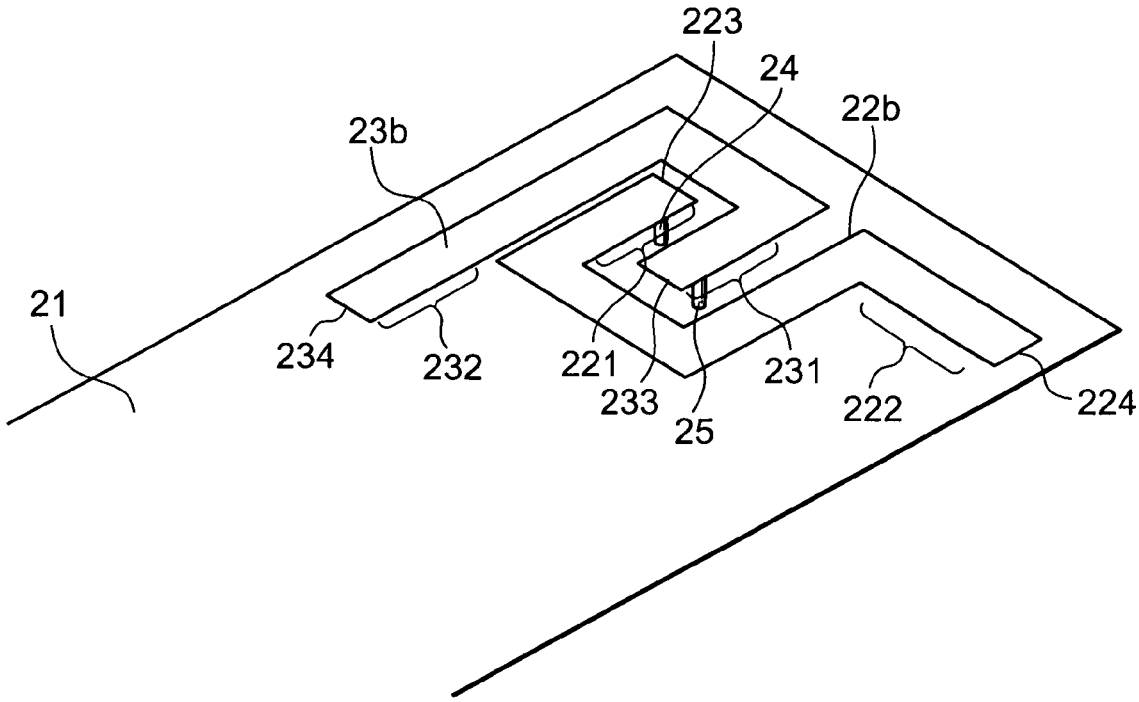
FIG. 8 is a schematic perspective view of an antenna apparatus according to a fifth embodiment of this invention.

FIG. 8 is a schematic perspective view of the antenna apparatus according to a fifth embodiment of this invention.

The antenna apparatus comprises a main antenna line element 22*b* and a parasitic antenna line element 23*b*. The antenna line elements 22*b* and 23*b* are located above the conductive plate 21 to be substantially parallel to the conductive plate 21.

The main antenna line element 22*b* comprises a first horseshoe shape portion including the first end portion 223. The parasitic antenna line element 23*b* comprises a second horseshoe shape portion including the third end portion 231. The third and the fourth end portions are substantially parallel to each other and oriented in the same direction.

The first and the second horseshoe shape portions are engaged with each other to leave space between them. The first end portion 221 is closer to the parasitic antenna line element 23*b* than the second end portion 222. The first end portion 221 is substantially parallel to both of the third and the fourth end portions 233 and 234 and oriented opposite directions.

With this structure, the feeding point is partly surrounded by the parasitic antenna line element 23*b*. That is, a part, adjacent to the feeding point, of the parasitic antenna element 23*b* is more than that of the parasitic antenna element 23 of FIG. 2. Consequently, the current flowing on the parasitic antenna element 23*b* is larger than that flowing on the parasitic antenna element 23 of FIG. 2. Thus, both of output power and receiving sensitivity of the antenna apparatus is larger than those of the parasitic antenna element 23 of FIG. 2.

While this invention has thus far been described in conjunction with the preferred embodiments thereof, it will readily be possible for those skilled in the art to put this invention into practice in various other manners. For example, a conductor having a wire shape may be used for each of the main antenna line element and the parasitic antenna line element. Furthermore, one or more additional parasitic antenna line elements are located above the conductive plate near the feeding point.

What is claimed is:

1. An antenna apparatus used for a radio communication device, comprising:

a conductive plate;

a main line antenna element located parallel to said conductive plate and having first and second end portions extending in different directions perpendicular to each other with said first and second end portions connected to each other, said first end portion providing a feeding point, said second end portion forming an open end; and a parasitic line antenna element located parallel to said conductive plate and having third and fourth end portions for being electrostatically coupled with said main antenna element; wherein said main line antenna element and said parasitic line antenna element are located so that said first end portion is closer to said parasitic line antenna than said second end portion and parallel to said third and said fourth end portions, and said third end portion and said fourth end portion are separated by a middle portion that is greater than either said third end portion or said fourth end portion, wherein said first end portion is arranged adjacent only one of said third end portion and said fourth end portion.

2. An antenna apparatus as claimed in claim 1, wherein said main line antenna element and said parasitic line antenna element are unified by the use of resin.

3. An antenna apparatus used for a radio communication device, comprising:

a conductive plate;

a main line antenna element located parallel to said conductive plate and having first and second end portions extending in different directions perpendicular to each other, said first end portion providing a feeding point, said second end portion forming an open end; and a parasitic line antenna element located parallel to said conductive plate and having third and fourth end portions for being electrostatically coupled with said main antenna element; wherein said main line antenna element and said parasitic line antenna element are located so that said first end portion is closer to said parasitic line antenna than said second end portion and parallel to said third and said fourth end portions, wherein said third end portion provides a grounding point connected to said conductive plate while said fourth end portion forms an open end;

said third end portion oriented in opposite direction of said first end portion and closer to said first end portion than said fourth end portion.

4. An antenna apparatus as claimed in claim 3, wherein said main line antenna element has an L shape while said parasitic line antenna element has an I shape.

5. An antenna apparatus as claimed in claim 3, wherein said main line antenna element and said parasitic line antenna element have horseshoe shaped portions including said first and said third end portions respectively;

said horseshoe shaped portions engaged with each other to leave space between said horseshoe shaped portions.

6. An antenna apparatus as claimed in claim 3, wherein said first portion provides another grounding point closer to a longitudinal edge thereof than said feeding point.

7. An antenna apparatus used for a radio communication device, comprising:

a conductive plate;

a main line antenna element located parallel to said conductive plate and having first and second end portions extending in different directions perpendicular to each other, said first end portion providing a feeding point, said second end portion forming an open end; and a parasitic line antenna element located parallel to said conductive plate and having third and fourth end portions for being electrostatically coupled with said main antenna element; wherein said main line antenna element and said parasitic line antenna element are located so that said first end portion is closer to said parasitic line antenna than said second end portion and parallel to said third and said fourth end portions, wherein said feeding point is located at equal distances from said third and said fourth end portions which forming open ends.

* * * * *